US005642714A

United States Patent [19]

Buckley

[11] Patent Number: 5,642,714

[45] Date of Patent: Jul. 1, 1997

[54] FUEL SYSTEM

[75] Inventor: Paul Buckley, Rainham, England

[73] Assignee: Lucas Industries, West Midlands, England

[21] Appl. No.: 554,112

[22] Filed: Nov. 6, 1995

[30] Foreign Application Priority Data

Nov. 12, 1994 [GB] United Kingdom ..... 9422864

[51] Int. Cl.[6] ..... F02M 47/00; F02M 41/16

[52] U.S. Cl. ..... 123/447

[58] Field of Search ..... 123/299, 300, 123/447, 446, 450

[56] References Cited

U.S. PATENT DOCUMENTS 5,146,894 9/1992 Rembold ..... 123/447
5,213,083 5/1993 Glassey ..... 123/447
5,462,028 10/1995 Buckley ..... 123/447

FOREIGN PATENT DOCUMENTS 0 643 221 A1 3/1995 European Pat. Off. .
2 449 795 9/1980 France .
57-073855 5/1982 Japan .
9322554 11/1993 WIPO .

*Primary Examiner*—Thomas N. Moulis
*Attorney, Agent, or Firm*—Robbins, Berliner & Carson

[57] ABSTRACT

A fuel system for use in supplying fuel to an injection nozzle is disclosed. The system comprises a fuel pump arranged to charge first and second accumulators, and control valve means operable to select which of the first and second accumulators is used to supply fuel to the nozzle. The system further comprises valve means interposed between the fuel pump and the second accumulator, the valve means being operable to permit fuel to flow from the fuel pump to the second accumulator once the fuel pressure within the first accumulator has attained a predetermined value.

13 Claims, 1 Drawing Sheet

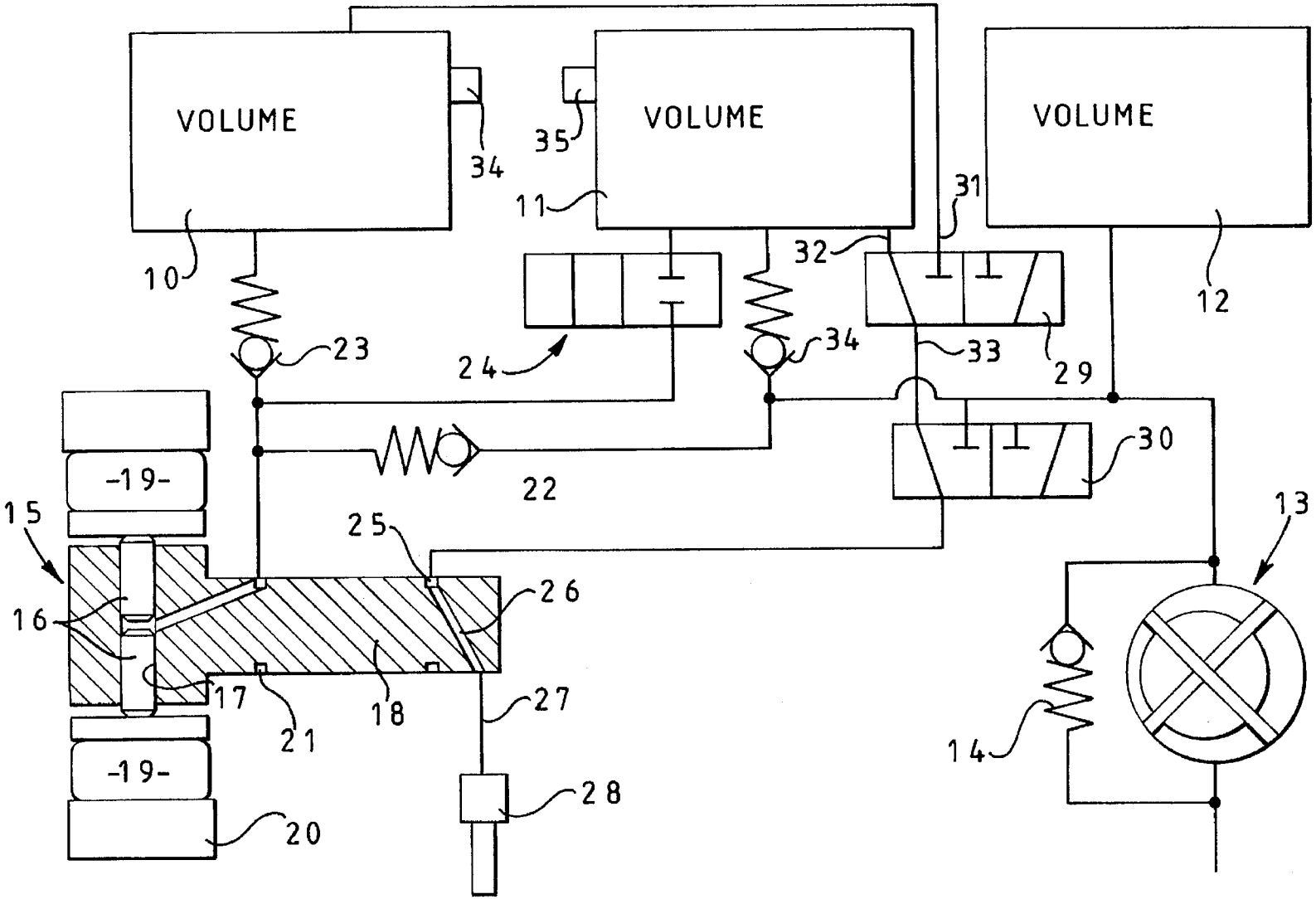
VOLUME
VOLUME
VOLUME
-19-
-19-
10
11
12
13
14
15
16
17
18
20
21
22
23
24
25
26
27
28
29
30
31
32
33
34
34
35

FUEL SYSTEM

This invention relates to a fuel system for supplying fuel to an injection nozzle of an internal combustion engine, the system including an accumulator in which fuel is stored at a high pressure, pump means for charging the accumulator with fuel and valve means operable to connect the accumulator to the fuel injection nozzle when it is required to supply fuel to the engine. A fuel system of this type is described in WO93/22554.

An object of the invention is to provide a fuel system of the kind specified in a simple and convenient form.

According to the present invention there is provided a fuel system for supplying fuel to an injection nozzle, the fuel system comprising a first accumulator arranged to store fuel at a first pressure, pump means for charging the first accumulator with fuel, the first accumulator being arranged to receive fuel from the pump means through a non-return valve, and control valve means operable to connect the first accumulator to the nozzle, and characterised by a second accumulator arranged to store fuel at a second pressure lower than the first pressure, the valve means being operable to select which of the first and second accumulators is used to supply fuel to the nozzle, and a two-way valve interposed between the second accumulator and the pump means and operable to allow fuel to flow from the pump means to the second accumulator when the fuel pressure in the first accumulator has attained a predetermined value.

Such a fuel system is advantageous in that it permits the delivery of either relatively high pressure fuel or relatively low pressure fuel to the nozzle, the fuel system being of a relatively simple and convenient form.

An example of a fuel system in accordance with the invention will now be described with reference to the accompanying diagrammatic drawing.

Referring to the drawing there is provided a first accumulator 10 in which fuel is stored at a high pressure, a second accumulator 11 in which fuel is stored at a lower pressure and for convenience a third accumulator 12 in which fuel is stored at the outlet pressure of a low pressure fuel supply pump 13 which is of the vane type and which is provided with a relief valve 14.

Fuel for charging the accumulators 10, 11 is derived from a high pressure pump 15 which conveniently comprises a pair of cam actuated plungers 16 which are housed in a bore 17 formed in a rotary member 18 housed within a pump body. The plungers 16 at their outer ends engage cam followers respectively which include rollers 19 engageable with the internal peripheral surface of an annular cam ring 20. The cam ring is formed with at least one pair of diametrically disposed cam lobes whereby as the rotary member 18 is rotated, inward movement will be imparted to the plungers 16. The fuel displaced by the plungers during their inward movement is supplied by way of a drilling in the rotary member, to a circumferential groove 21 which is formed on the periphery of the rotary member and this communicates with the outlet of the low pressure pump 13 by way of a non-return valve 22, the non-return valve being orientated so that fuel can be supplied from the low pressure pump to the bore 17 to effect outward movement of the plungers 16 as will be described. The circumferential groove 21 is also in communication with the accumulator 10 by way of a further non-return valve 23 which is orientated so that fuel can be supplied to the accumulator during the inward movement of the plungers. The groove 21 also communicates with the accumulator 11 by way of a two way valve 24 which conveniently is operated by an electromagnetic actuator under the control of a control system which may be the engine control system. As an alternative to the groove 21 a series of ports and/or passages may be provided in the rotary member and the surrounding body so that fuel can flow to and from the bore 17 during the outward and inward movements of the plungers.

The rotary member 18 is driven by the associated engine in timed relationship therewith and it is provided with a further circumferential groove 25 which communicates with a delivery passage 26 formed in the rotary member. The delivery passage is positioned to register in turn with a plurality of outlets 27 (only one of which is shown), the outlets being connected by way of respective delivery valves, to the injection nozzles 28 respectively of the associated engine. As an alternative to the groove 25 the delivery passage 26 may connect in turn, with a series of ports spaced about the rotary member.

The high pressure pump 15 since its rotary part is part of the rotary member is also driven in timed relationship with the engine but it may be a separate item and driven by a separate drive arrangement.

Also provided is a pair of three way valves 29, 30. Considering the valve 29, the alternative inlets 31, 32 are connected to the accumulators 10, 11 respectively and the common connection 33 is connected to one of the alternative inlets of the valve 30. The other alternative inlet of the valve 30 is connected to the outlet of the low pressure pump 13 and the common connection of the valve 30 is connected to the circumferential groove 25 or to the aforesaid ports. The valves 29 and 30 are again electromagnetically operated by respective actuators the control of current to which is effected by means of the control system. The control system receives signals from pressure transducers 34, 35, associated with the accumulators 10, 11 in order to determine the operating time at least of the valve 24.

In operation, the valve 29 selects which accumulator is to supply fuel to the fuel injection nozzle whose associated outlet 27 is in communication with the delivery passage 26. The valve 30 is set to connect the common port 33 of the valve 29 with the circumferential groove 25 so that fuel under pressure from the accumulator 11 will be supplied to the nozzle 28. Such a supply of fuel will be at a comparatively low rate and when an increased rate of fuel supply is required the valve 29 is moved to its alternative position so that fuel is supplied from the accumulator 10. The termination of fuel flow is effected by moving the valve 30 to the alternative position to that which is shown in the drawing. The practical effect of such movement is to terminate delivery of fuel to the nozzle but also to lower the pressure in the passages in the rotary member and the outlets up to the delivery valves, to the outlet pressure of the low pressure pump by allowing fuel to escape to the accumulator 12. This permits the fuel pressure actuated valve member in the nozzle to close quickly onto its seating.

Considering now the operation of the high pressure pump 15, as the plungers 16 start to move inwardly fuel is discharged from the bore 17 and with the valve 24 in the setting shown, the fuel flows to the accumulator 10 by way of the non-return valve 23. When it is determined from the signal provided by the transducer 34, that the fuel pressure in the accumulator has attained the desired value, the valve 24 is switched to the alternative position to that shown in the drawing so that the fuel delivered by the high pressure pump now flows to the accumulator 11. The fuel under pressure in the accumulator 10 is trapped by closure of the non-return valve 23. The pressure in the accumulator 11 rises as the plungers move inwardly but as the plungers move over the crests of the cam lobes, starts to fall as the plungers are urged outwardly. When the pressure in the accumulator 11 reaches the desired value, as indicated by the signal from the transducer 35, the valve 24 is moved to the position in which it is shown in the drawing so that no further fuel flows from the accumulator 11 to the bore 17. The plungers however can continue to move outwardly as permitted by the profiles of the trailing flanks of the cam lobes, by the action of fuel under pressure from the low pressure pump which flows past the non-return valve 22. In practice the response times of the valve operating circuit and the valve 24 may be too long for the valve to operate in the same cycle of operation without substantial pressure overshoot. It is likely therefore that the pressure rise in the accumulators 10 and 11 will have to be predicted on the basis of previous performance.

As an alternative to operating only the valve 30 to terminate fuel delivery to the engine, the valve 29 may be operated to connect the accumulator 11 to the common port 33 of the valve. This will allow the pressure in the passages in the rotary member 18 and the pipeline to fall by returning the high pressure fuel to the accumulator 11. This alone will not reduce the pressure by a sufficient amount to terminate delivery of fuel, this being achieved by operating the valve 30 as previously described.

The initial priming of the accumulators 10, 11 takes place by way of the valves 22 and 23 in the case of the accumulator 10 and by way of a non return valve 34 in the case of the accumulator 11, the valve being interposed between the outlet of the low pressure supply pump 13.

When cranking the engine for starting purposes, in order to minimise the load on the starter motor, the valve 24 would be set in the alternative position to that shown in order to ensure that the accumulator 11 received fuel from the high pressure pump. The accumulator 10 would also receive fuel if the pressure of fuel stored therein was equal to or less than the pressure in the accumulator 11.

In a typical example the pressures in the accumulators 10, 11 are of the order of 1200 Bar and 400 Bar respectively.

I claim:

1. A fuel system for supplying fuel to an injection nozzle, the fuel system comprising a first accumulator arranged to store fuel at a first pressure, pump means for charging the first accumulator with fuel, the first accumulator being arranged to receive fuel from the pump means through a non-return valve, and control valve means operable to connect the first accumulator to the nozzle, wherein a second accumulator arranged to store fuel at a second pressure lower than the first pressure, the valve means being operable to select which of the first and second accumulators is used to supply fuel to the nozzle, and a two-way valve interposed between the second accumulator and the pump means and operable to allow fuel to flow from the pump means to the second accumulator when the fuel pressure in the first accumulator has attained a predetermined value.

2. A fuel system as claimed in claim 1, wherein the two-way valve is arranged to control the fuel pressure in the second accumulator.

3. A fuel system as claimed in claim 2, wherein, in use, the fuel pressure within the second accumulator is allowed to exceed the second pressure, the two-way valve being operable to permit fuel to escape therethrough from the second accumulator to the pump means whilst the pressure of fuel within the second accumulator exceeds the second pressure.

4. A fuel system as claimed in claim 1, further comprising second pump means for supplying fuel to the pump means.

5. A fuel system as claimed in claim 4, further comprising valve means arranged to permit fuel to be supplied to the first and second accumulators by the second pump means when the fuel pressure within the first and second accumulators is less than the pressure of the fuel supplied by the second pump means.

6. A fuel system as claimed in claim 4, further comprising a third, low pressure, accumulator arranged to communicate with the outlet of the second pump means.

7. A fuel system as claimed in claim 1, wherein the control valve means comprises a first three-way valve operable to select which of the first and second accumulators is used to supply fuel to the injector nozzle, and a second valve connected to the outlet of the first three-way valve and operable to control the timing of fuel delivery to the nozzle.

8. A fuel system as claimed in claim 7, wherein the first three-way valve is operable to permit communication between the second accumulator and the nozzle prior to termination of fuel delivery.

9. A fuel system as claimed in claim 7, wherein the second valve comprises a three-way valve.

10. A fuel system as claimed in claim 9, wherein the second valve is switchable between a position in which it connects the nozzle to the first valve and a position in which the nozzle is connected to a source of relatively low pressure fuel.

11. A fuel system as claimed in claim 10, wherein the source of relatively low pressure fuel is the outlet of the second pump means.

12. A fuel system as claimed in claim 1, wherein the pump means includes a plunger reciprocable under the influence of a cam surface.

13. A fuel system as claimed in claim 12, wherein the plunger constitutes part of a rotary fuel pump.

* * * * *